US005251556A

United States Patent [19]

Ravenelle et al.

[11] Patent Number: 5,251,556

[45] Date of Patent: Oct. 12, 1993

[54] AUXILIARY BED EXTENSION FOR SEWING MACHINE

[76] Inventors: Lucien Ravenelle; Richard Lacasse, both of 42 Montcalm Street, St-Pie (Quebec), Canada, J0H 1W0

[21] Appl. No.: 925,164

[22] Filed: Aug. 6, 1992

[51] Int. Cl.[5] ..... D05B 73/10

[52] U.S. Cl. ..... 112/260; 112/217.1; 108/90; 108/102; 108/69

[58] Field of Search ..... 112/260, 217.1; 108/50, 108/69, 90, 97, 102; 312/208.5

[56] References Cited

U.S. PATENT DOCUMENTS

| | | | |
|---|---|---|---|
| 901,052 | 10/1908 | Winkel | 112/260 |
| 2,305,343 | 12/1942 | Gadbois | 108/69 X |
| 2,424,025 | 7/1947 | Gegauf . | |
| 2,631,074 | 3/1953 | Stump | 108/102 |
| 2,709,978 | 6/1955 | Adler . | |
| 2,909,401 | 10/1959 | Bjorgan | 312/208.5 X |
| 3,797,425 | 3/1974 | Peets | 112/217.1 |
| 4,114,548 | 9/1978 | Kasahara et al. . | |
| 4,426,944 | 1/1984 | Bianchi . | |
| 4,565,142 | 1/1986 | McGann . | |

FOREIGN PATENT DOCUMENTS

| | | |
|---|---|---|
| 160559 | 2/1915 | Canada . |
| 245525 | 12/1924 | Canada . |

*Primary Examiner*—Clifford D. Crowder
*Assistant Examiner*—Paul C. Lewis
*Attorney, Agent, or Firm*—Pierre Lespérance; Francois Martineau

[57] ABSTRACT

An auxiliary bed extension U-shape plate destined to be edgewisely mounted to the cylinder bed of a sewing machine for increasing the planar work supporting surface thereof. The bed extension comprises a main, rigid, panel defining an inner recess for shapingly conforming to the cylinder bed, the inner recess of generally quadrangular shape. The web of the U-shape extension plate is telescopingly extensible and the two side legs thereof are extensible with add-on strips, wherein the extensible bed is adjustable in length as well as in width. The panel is supported edgewisely to the cylinder bed in generally coplanar fashion to the work supporting surface of the latter, whereby an enlarged, planar, generally coextensive, work supporting surface is obtained by the cylinder bed and extension bed plate.

5 Claims, 2 Drawing Sheets

AUXILIARY BED EXTENSION FOR SEWING MACHINE

FIELD OF THE INVENTION

This invention relates to auxiliary bed plates for temporarily extending the fabric supporting surface of a sewing machine of the hands-off sewing head type.

BACKGROUND OF THE INVENTION

Industrial sewing machines of conventional, hands-off, sewing head type make, generally define a supporting base from which frontwardly projects a much narrower main cylinder bed. The cylinder bed is narrow, for reducing weight and storage volume. The top, planar work surface of the free end of the cylinder bed comprises a throat plate and a slide cover plate, underlying the reciprocatable needle bar and presser bar carried by the sewing head.

It has long been recognized in the art that, for carrying out fabric sewing operations in an efficient fashion, the top, work supporting surface of the narrow cylinder bed should be temporarily enlarged, so as to address the difficulties in the handling of flat work pieces, particularly those of large size. This is why auxiliary bed plate extension members have been provided: see for instance Gegauf U.S. Pat. No. 2424025; Kasahara et al U.S. Pat. No. 4114548: McGann U.S. Pat. No. 4565142.

In this latter U.S. Pat. No. 142', the cylinder bed extension 30 is of U-shape, providing a planar, upper work surface 32, and defining a central recess 33 shaped to conform to the cylinder bed work supporting surface 15. The planar, work-supporting surface 32 of the U-shape bed extension extends coplanar with the work supporting surface 15 of the cylinder bed 13, so that both surfaces may serve as an enlarged, common work supporting surface.

These U-shaped bed extensions have been plagued by problems in the past. First, locking of the bed extension to the sewing machine was not totally secure, due to low resistance to dislodgement in view of the known usual forces applied during work manipulation during sewing. Also, because the dimensions of sewing machine beds usually differ for different manufacturers, as will the dimensions which may be selected for web thicknesses, flange widths, etc. . ., in the bed extension, a variety of bed extensions of different sizes must be acquired and stored by companies in the garment manufacturing business, whenever—as is usually the case —more than one make of sewing machines are used. The reasons why cylinder beds of different sewing machine manufacturers are of different sizes, may have to do with these manufacturer's concern that parts from one competitor could undesirably be acquired by a user to fit their own sewing machine. That is to say, different standards in size promote customer brand loyalty. This is not in the interest of the customer-user of the sewing machines.

OBJECTS OF THE INVENTION

The gist of the invention is therefore to provide an auxiliary bed extension plate, which will be of adjustable dimensions to fit sewing machines of different make having cylinder beds of different sizes.

Corollary objects of the invention include: making the bed extension cost effective, rendering same able to be applied and removed quickly and easily to the sewing machine, that the bed extension resist dislodgement during work fabric manipulation during sewing.

SUMMARY OF THE INVENTION

Accordingly with the objects of the invention, there is disclosed an auxiliary bed extension member destined to be mounted to the cylinder bed of a sewing machine for increasing the planar work supporting surface thereof, said extension member comprising:

(a) a main, rigid, panel member, said panel member defining an inner recess for shapingly conforming to said cylinder bed, said inner recess of generally quadrangular shape;

(b) first adjustment means, for adjustably varying the width of said inner recess;

(c) second adjustment means, for adjustably varying the length of said inner recess; and (d) means for releasably securing said panel member to said cylinder bed in generally coplanar fashion with the work supporting surface of the latter, whereby an enlarged, planar, generally coextensive, work supporting surface is obtained by said cylinder bed and panel member.

DETAILED DESCRIPTION OF THE INVENTION

Figure 1:
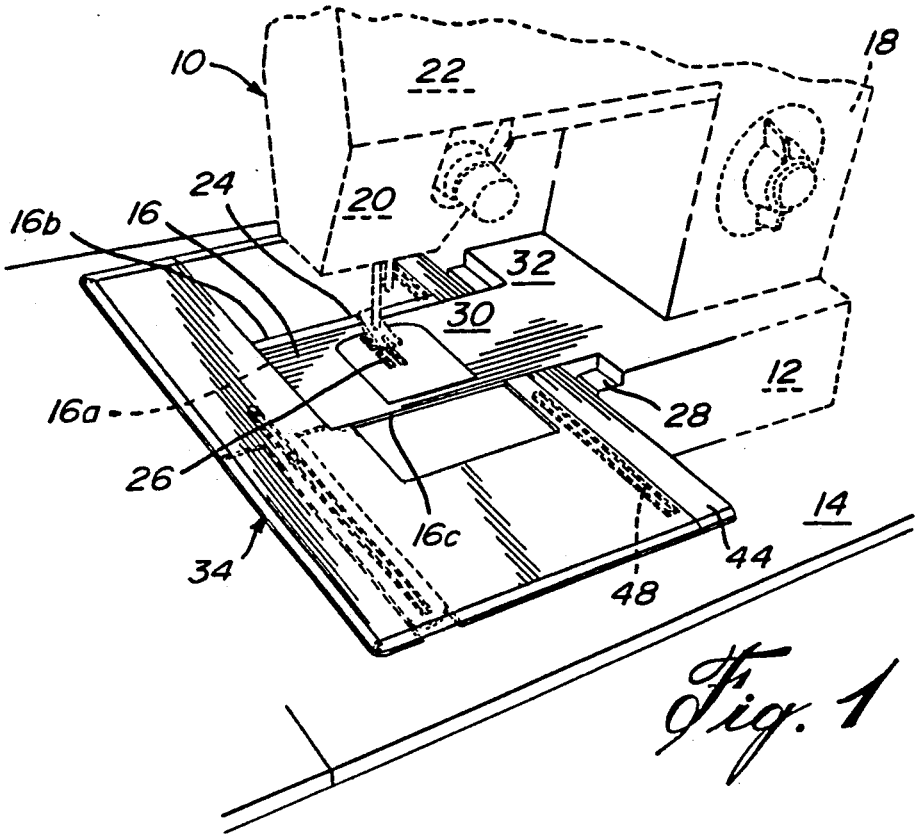
FIG. 1 is a perspective view of a sewing machine, in dotted lines, and further showing in full lines the auxiliary extension bed plate installed around the main cylinder bed.

Sewing machine 10 defines a supporting base 12, to stand over a work table 14 inside a lodging, open-top cavity. An integral, narrow, horizontal, cylinder bed 16 forwardly projects from the base 12. An aft, upright standard 18 projects from base, and supports over bed 16 a front sewing head 20 via a horizontal link arm 22. The bottom end of head 20 carries the usual, power-driven, needle bar and presser bar assembly 24, destined to vertically reciprocate over the throat plate and slide cover plate assembly 26 of the cylinder bed 16. The two front wall portions of base 12, on each side of the cylinder bed 16, conventionally carry downwardly-forwardly-inclined, downwardly- offset projecting ears 28, beneath the level of the (top) planar, work supporting surface 30 of cylinder bed 16. The top surface 32 of base 12 is coplanar to work supporting surface 30 of bed 16. The bed top surface 30 is generally rectangular.

According to the invention, a U-shape, auxiliary bed extension member 34 is provided, to shapingly conform with and fit edgewisely on bed 16 coplanar therewith. U-shape member 34 defines a web 36 and two side legs 38 and 40, and a U-shape recess formed by the inner free edges **36*a*, 38*a* and 40*a* of legs 36–40. Each leg 36, 38, 40 of U-shape member 34 includes separate means for adjusting the individual length thereof, wherein both the width and the overall length of the U-shape member 34 is adjustable to enable recess 36*a*, 38*a* and 40*a* to snugly conform shapingly with the lateral side and front edges of generally quadrangular cylinder bed 16. More precisely, each inner edge 36*a*, 38*a*, 40*a* is of adjustable length, thanks to said adjustment means (detailed below). Inner edge 36*a* of extension member 34** is destined to edgewisely abut against the front edge 16a (i.e., the free end edge) of cylinder bed 16; whereas lateral side edges 38a, 40a are destined to edgewisely abut against the lateral side edges 16b and 16c of cylinder bed 16; whereby auxiliary bed 34 is to become coplanar to main bed 16, thanks to securing means (detailed below).

Figure 5:
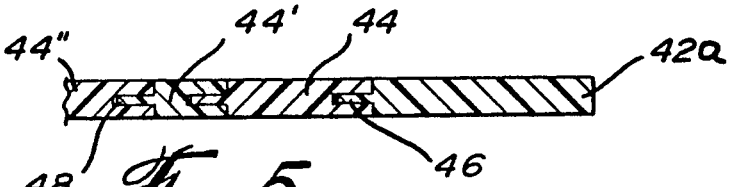

The length adjusting means for legs 38 and 40 is best shown in FIG. 5. Each leg, 38, 40 includes a main, thin, rigid panel sheet 42, defining a free, aft outer edge 42a. A selected number of panel extension strips 44, 44', 44'', . . . are edgewisely connected serially to sheet edge 42a, as add-on elements, i.e. strip 44 to sheet edge 42a; strip 44' to strip 44; strip 44'' to strip 44'; and so on. Interconnection is made by tenon and mortise, friction fit, edgewise joints, each defining a male edgewise lip 46 made thicknesswisely intermediate the sheet 42, and a female cavity 48 for receiving lip 46. Strips 44, 44', 44'', . . . have substantially the same thickness and width as main panel 42, but are much shorter in length. In this way, small, incremental increases in length of legs 38 or 40 may be achieved to fit cylinder beds 16 of different sizes.

Strips 44, 44', . . . should be made from the same material as parts 36 and 42, preferably a lightweight, low cost, moldable, plastic material. Strips 44, 44', . . . need not be of equal length, as suggested in FIG. 2.

Figure 6:
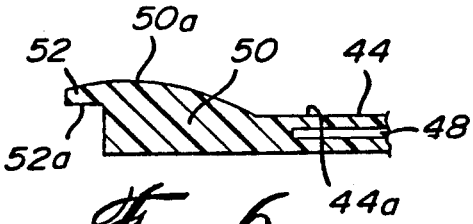

As best seen in FIG. 6, the inner edge of each first strip 44 may carry an inwardly projecting bulge or ear 50. Bulge 50 inwardly thickens, while forming a smooth convex top wall 50a. From the inner edge of top convex wall 50a projects an inward lip 52 coextensive therewith. Lip 52 is much thinner than bulge 50 and defines a flat underface 52a, being upwardly offset from the plane of the top face 44a of strip 44. Lip 52 is destined to retainingly engage cylinder bed 16 with lip underface 52a resting flatly against top face 30 of cylinder bed 16, on each of the two lateral sides of the latter.

Figure 3:
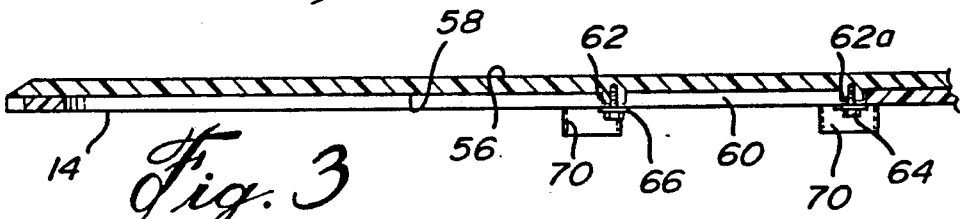
FIGS. 3–6 are cross-sectional views taken about lines 3—3, 4—4, 5—5 and 6—6 respectively of FIG. 2.
Figure 4:
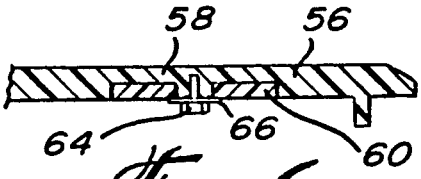

It is understood that, generally speaking, and as is customary in the art, sewing machine 18 is lodged into an upwardly opening cavity at the top of desk 14, with base 12 generally below the top mouth of this desk cavity. Insert 34 would be of sufficiently large overall dimensions, even in the fully groove-engaged condition of tongue 60, so that the outer peripheral edge sections of web leg 36 and side legs 38, 40 would continuously abut against the raised edge portions of the supporting table 14, at the periphery of the top mouth of that table upper cavity mouth. The [-auxiliary bed extension 34 would thus be automatically maintained in generally coplanar fashion with cylinder bed 16, since upon base 12 standing into the flooring of the cavity of desk 14, top wall 32 of base 12 is destined to be automatically coplanar to the top wall of desk 14. The means to adjust the length of web segment 36 will now be detailed, having reference to FIGS. 2–4 of the drawings. Web member 36 in fact consists of two separate parts 54, and 56. Part 54 is integral with leg 40, part 56, with leg 42. Half part 56 includes a lengthwise, intermediate groove 58, made about the underface thereof and extending transversely of leg 42 and opening outwardly at both ends of groove 58. Full part 54 includes an elongated rigid tongue 60.

Tongue 60 projects inwardly from the bottom half thickness section of part 54, and preferably defines a rounded free end tip 60a. The combination of part 54 and rigid tongue 60 is preferably of the same length as full web leg 36. Rigid tongue 60 is of a thickness and width corresponding to that of groove 58, wherein the former releasably engages slidingly into the latter.

Thus, by pulling leg 38 away from leg 40, tongue 60 progressively retracts (continuously) from groove 58, thereby increasing the length of web 36, and thus, increasing the width 36a of the inner U-shape recess 36a, 38a, 40a of U-shape insert 34. Each part 54, 56 thus defines an inner edge 54a, 56a which will abut against each other in a narrowest condition of insert 34, i.e. when tongue 60 is completely engaged into groove 58.

Figure 2:
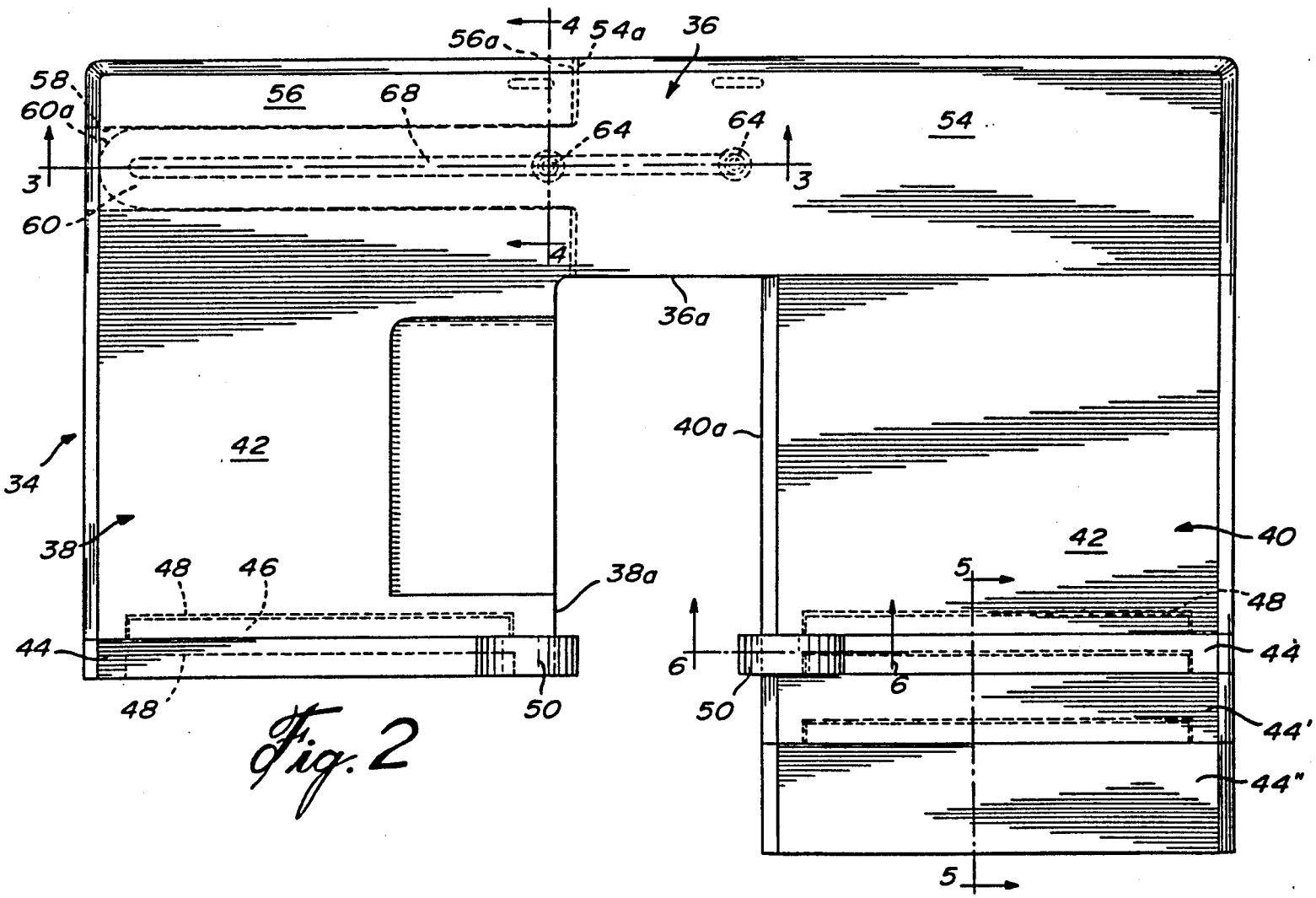
FIG. 2 is a top plan view of the auxiliary bed U-shape plate.

As clearly illustrated in FIG. 2, a lengthwise, elongated, ovoidal slit 68 is further made transversely of rigid tongue 60, and further continuing into the adjacent portion of the underface half-thickness of part 54. Two downwardly protruding sockets 62 are mounted into slit 68, one at the inner end of slit 68 (integral to and depending from part 54) and the other at the inner end of tongue 68. Sockets 62 include a downwardly opening, threaded cavity 62a, threadingly receiving a bolt 64. A rigid washer 66 is provided between the bolt head 64a and the bottom free end of socket 62, with washer 66 diametrally larger than socket 62. Lengthwise slit 68 is slidingly engaged by the stem of bolt 64, the width of slit 68 being smaller than the diameter of washer 66. Hence, by screw tightening bolts 64 into threaded sockets 62, washer 66 will frictionally lock tongue 60 against parts 54 and 56. Access to the bottom head of bolt 64 will be made possible by apertures 70 made in the top wall of table 14, in register with bolts 64.

I claim:

1. An auxiliary bed extension member for use with a flat cylinder bed of a sewing machine, for increasing the planar, work-supporting surface defined by that sewing machine, said extension member comprising:

(a) a main, rigid, panel member, said panel member defining a generally U-shape, having a transverse web leg and two lateral side legs;

(b) first adjustment means, for adjustably varying the width of said inner recess, and including telescopic means for telescopingly extending said web leg; and (c) second adjustment means, for adjustably varying the length of at least one of said lateral side legs.

2. An auxiliary bed extension member for a sewing machine as defined in claim 1, wherein said second adjustment means includes two sets of a number of short, planar, extension strips, one for each of said side legs, and releasable strip anchor means to serially interconnect a selected number of said strips from each said set coextensively to the corresponding said side legs, whereby the length of at least one of said side legs is incrementally increased.

3. An auxiliary bed extension member for a sewing machine as defined in claim 4, wherein said strip anchor means includes intermediate projecting lips, edgewisely carried by said strips, and corresponding intermediate cavities, edgewisely made at said side legs and also in said strips opposite said lips and shapingly conforming to said lips.

4. An auxiliary bed extension member for a sewing machine as defined in claim 3, wherein there is a releasably friction fit engagement of said strip lips into said strip edgewise cavities and into said side legs edgewise cavities.

5. An auxiliary bed extension member for a sewing machine as defined in claim 1, wherein said first adjustment means is defined by said web leg consisting of two separate, coextensive, first and second parts, said first part having an elongated, rigid, narrow tongue projecting axially inwardly, said second part having an elongated, narrow groove on its underface, said groove of a shape corresponding to said tongue, said tongue slidingly engaging said groove; and further including means to releasably anchor said tongue to said second part, at a selected tongue position within said groove.

* * * * *